US010071534B2

(12) United States Patent
Pradelli

(10) Patent No.: US 10,071,534 B2
(45) Date of Patent: Sep. 11, 2018

(54) FOLDING UNIT AND METHOD FOR PRODUCING POURABLE FOOD PRODUCT PACKAGES

(75) Inventor: Massimo Pradelli, Reggio Emilia (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 746 days.

(21) Appl. No.: 14/127,503

(22) PCT Filed: Sep. 5, 2012

(86) PCT No.: PCT/EP2012/067241
§ 371 (c)(1),
(2), (4) Date: Feb. 11, 2014

(87) PCT Pub. No.: WO2013/064287
PCT Pub. Date: May 10, 2013

(65) Prior Publication Data

US 2014/0194267 A1 Jul. 10, 2014

(30) Foreign Application Priority Data

Oct. 31, 2011 (EP) ..... 11187356

(51) Int. Cl.
*B31B 1/26* (2006.01)
*B65B 49/04* (2006.01)
(Continued)

(52) U.S. Cl.
CPC ..... *B31B 1/26* (2013.01); *B65B 49/04* (2013.01); *B65B 49/08* (2013.01); *B65B 49/14* (2013.01); *B65B 61/24* (2013.01); *B65B 9/20* (2013.01)

(58) Field of Classification Search
CPC ..... B65B 61/24; B65B 19/52; B65B 19/36; B65B 7/18; B65B 47/00; B31B 1/26;
(Continued)

(56) References Cited

U.S. PATENT DOCUMENTS 2,481,611 A * 9/1949 Moore ..... B65B 1/24 100/232
3,332,198 A * 7/1967 Thesing ..... B65B 61/24 53/436
(Continued)

FOREIGN PATENT DOCUMENTS

CA 2426525 A1 * 3/2004 ..... B65B 7/04
CN 1525923 A 9/2004
(Continued)

OTHER PUBLICATIONS

Office Action (Notice of Reasons for Rejection) dated Jun. 6, 2016, by the Japanese Patent Office in corresponding Japanese Patent Application No. 2014-537529, and an English translation of the Office Action. (6 pgs).
(Continued)

*Primary Examiner* — Thanh Truong
*Assistant Examiner* — Dariush Seif
(74) *Attorney, Agent, or Firm* — Buchanan Ingersoll & Rooney PC

(57) ABSTRACT

A folding unit for producing folded packages of pourable food products from sealed packs, comprising: movable conveyor which are fed with a plurality of packs at an input station, which feed packs along a forming path and output folded packages at an output station; and folder cooperating with each pack to perform at least one folding operation on pack comprising: at least one pair of shells which are integrally movable along the forming path and are movable relative to each other along a direction transversal to the forming path; shells of each pair may be set along the direction in: a fully closed position in which they exert a pressure onto a relative pack, so as to at least complete a folding operation onto relative pack; and an open position in
(Continued)

which they are detached from the corresponding folded package.

18 Claims, 15 Drawing Sheets

(51) Int. Cl.
*B65B 49/08* (2006.01)
*B65B 49/14* (2006.01)
*B65B 61/24* (2006.01)
*B65B 9/20* (2012.01)

(58) Field of Classification Search
CPC .... B31B 3/02; B31B 1/52; B31B 1/54; B31B 1/56; B31B 1/58; B31B 1/44; B31B 1/46
USPC ..... 53/375.2; 493/243, 174, 143, 263, 244, 493/248, 253, 247; 198/377.07, 867.1, 198/803.13, 803.1, 465.4, 485.1, 369.2, 198/620, 621
See application file for complete search history.

(56) References Cited

U.S. PATENT DOCUMENTS 3,857,223 A * 12/1974 Dominici ..... B65B 61/24 53/526
4,034,537 A * 7/1977 Reil ..... B29C 65/7451 53/141
4,387,547 A * 6/1983 Reil ..... B65B 9/2014 53/131.5
4,390,093 A * 6/1983 Chard, Jr. ..... B65G 17/34 198/803.13
4,462,202 A * 7/1984 Reil ..... B65B 61/24 198/803.9
4,510,732 A * 4/1985 Lothman ..... B65B 61/24 493/218
4,528,803 A * 7/1985 Ott ..... B65B 3/02 493/164
5,261,520 A * 11/1993 Duke ..... B42C 19/08 198/375
5,966,899 A * 10/1999 Fontanazzi ..... B65B 7/20 53/374.7
6,312,370 B1 * 11/2001 Allmon ..... B65D 3/06 229/104
6,343,688 B1 * 2/2002 McKinlay ..... A01K 31/165 119/337
7,036,658 B2 * 5/2006 Hartness ..... B65G 17/323 198/468.2
7,793,484 B2 * 9/2010 Santi ..... B65B 7/18 53/374.7
9,409,368 B2 * 8/2016 Catellani ..... B31B 3/02
2001/0029721 A1 * 10/2001 Sato ..... B65B 61/24 53/376.4
2004/0169066 A1 9/2004 Palm
2009/0113848 A1 * 5/2009 Santi ..... B65B 7/18 53/374.7
2009/0193763 A1 * 8/2009 Fontanazzi ..... B65B 49/08 53/456
2010/0270121 A1 * 10/2010 Meyerhans ..... B65H 15/00 198/377.07
2013/0237396 A1 * 9/2013 Paradisi ..... B65B 1/02 493/243
2014/0196417 A1 * 7/2014 Galata' ..... B65B 61/24 53/551
2014/0223858 A1 * 8/2014 Pedretti ..... B65B 35/58 53/203
2014/0283489 A1 * 9/2014 Zhu ..... B65G 17/32 53/491
2014/0371046 A1 * 12/2014 Catellani ..... B31B 3/02 493/162
2015/0251374 A1 * 9/2015 Lopez-Arostegui Saenz ..... B31B 1/64 383/38

FOREIGN PATENT DOCUMENTS

DE 1 913 258 U 4/1965
DE 197 11 415 C1 9/1998
EP 0 887 268 A1 12/1998
EP 1059236 A1 * 12/2000 ..... B29C 66/8226
EP 1 726 526 A1 11/2006
EP 2746170 A1 * 6/2014 ..... B65B 61/24
JP H02-269607 A 11/1990

OTHER PUBLICATIONS

U.S. Appl. No. 14/127,505, filed Feb. 11, 2014, Pedretti et al.
U.S. Appl. No. 14/127,613, filed Jan. 24, 2014, Pedretti et al.
U.S. Appl. No. 14/127,586, filed Jan. 24, 2014, Galata.
U.S. Appl. No. 14/127,506, filed Jan. 22, 2014, Pedretti et al.
U.S. Appl. No. 14/127,520, filed Jan. 22, 2014, Pedretti et al.
International Search Report (PCT/ISA/210) dated Dec. 7, 2012, by the Eutopean Patent Office as the International Searching Authority for International Application No. PCT/EP2012/067241.
Office Action (Text of First Office Action) dated Feb. 2, 2015, by the Chinese Patent Office in corresponding Chinese Patent Application No. 201280032843.9, and an English Translation of the Office Action. (14 pages).

* cited by examiner

FOLDING UNIT AND METHOD FOR PRODUCING POURABLE FOOD PRODUCT PACKAGES

TECHNICAL FIELD

The present invention relates to a folding unit and to a method for producing folded packages of pourable food products from relative sealed packs.

BACKGROUND ART

As is known, many food products, such as fruit juice, pasteurized or UHT (ultra-high-temperature treated) milk, wine, tomato sauce, etc., are sold in packages made of sterilized packaging material.

A typical example of this type of package is the parallelepiped-shaped package for liquid or pourable food products known as Tetra Brik Aseptic (registered trademark), which is made by folding and sealing laminated strip packaging material.

The packaging material has a multilayer structure substantially comprising a base layer for stiffness and strength, which may comprise a layer of fibrous material, e.g. paper, or of mineral-filled polypropylene material; and a number of layers of heat-seal plastic material, e.g. polyethylene film, covering both sides of the base layer.

In the case of aseptic packages for long-storage products, such as UHT milk, the packaging material may also comprise a layer of gas- and light-barrier material, e.g. an aluminium foil or an ethyl vinyl alcohol (EVOH) foil, which is superimposed on a layer of heat-seal plastic material, and is in turn covered with another layer of heat-seal plastic material forming the inner face of the package eventually contacting the food product.

As is known, packages of this sort are produced on fully automatic packaging machines, on which a continuous tube is formed from the web-fed packaging material. The web of packaging material is sterilized on the packaging machine, e.g. by applying a chemical sterilizing agent, such as a hydrogen peroxide solution, which, once sterilization is completed, is removed from the surfaces of the packaging material, e.g. evaporated by heating. The web of packaging material so sterilized is maintained in a closed, sterile environment, and is folded and sealed longitudinally to form a vertical tube.

The tube is filled continuously downwards with the sterilized or sterile-processed food product, and is sealed and then cut along equally spaced cross sections to form pillow packs, which may be fed to a folding unit to form the finished packages.

More specifically, the pillow packs substantially comprise a main portion, and opposite top and bottom end portions tapering from the main portions towards respective top and bottom sealing bands which extend substantially orthogonal to the axis of the pack. In detail, each end portion is defined by a pair of respective trapezoidal walls which extend between main portion of the pack and the relative sealing band.

Each pillow pack also comprises, for each top and bottom end portion, an elongated substantially rectangular fin projecting from respective sealing bands; and a pair of substantially triangular flaps projecting from opposite sides of relative end portion and defined by respective trapezoidal walls.

The end portions are pressed towards each other by the folding unit to form flat opposite end walls of the pack, while at the same time folding the flaps of the top portion onto respective lateral walls of the main portion and the flaps of the bottom portion onto the bottom sealing band.

Packaging machines for producing packages of the above type are known, substantially comprising:

- an in-feed conveyor;
- a folding unit receiving the pillow packs from the in-feed conveyor and adapted to fold these pillow packs to form the parallelepiped-shaped packages;
- a transfer unit for transferring and up-ending the folded packages, which is arranged downstream from the folding unit and receives the sealed packages from the folding unit; and
- an out-feed conveyor which receives folded packages from the transfer unit and moves them away from the packaging machine.

Folding units are known, for example from EP-B-0887261 in the name of the same Applicant, which typically comprise:

- a chain conveyor for feeding packs continuously along a forming path from a supply station to an output station;
- a number of folding devices arranged in fixed positions relative to the forming path and cooperating with packs to perform relative folding operations thereon;
- a heat-sealing device acting on respective triangular flaps of each pack to be folded, to melt the external layer of the packaging material and seal flaps onto respective walls of the pack; and
- a pressing device cooperating with each pack to hold the triangular portions on respective walls as these portions cool.

In detail, the chain conveyor comprises a top straight branch, a bottom straight branch and two curved portions which are opposite to each other and connect, on respective opposite sides, the top and bottom branches.

More precisely, the axes of the packs are slightly backwards inclined relative to a vertical direction when they are fed to the chain conveyor at the supply station, and are substantially vertical when packs are fed along the top branch. Furthermore, the folded packages are slightly forwards inclined relative to the vertical direction, when they reach the output station.

In other words, when moving along the forming path, the packs and the corresponding folded packages are arranged above and are, therefore, continuously supported by the chain conveyor.

The pressing device comprises three endless belts which define, between them and together with the top branch of the chain, a forming passage having a constant rectangular section, and defining the outer contour of the finished packages.

Transfer units are known, for example from EP-B-0887268 in the name of the same Applicant.

In detail, the known transfer units move the packages successively along a path from an in-feed station to an out-feed station, and simultaneously up-end the packages from an in-feed position, in which the packages are positioned with their axis tilted roughly 15° to the horizontal, into an out-feed position, in which the packages are positioned with their axis substantially vertical.

More specifically, the in-feed position of the transfer unit substantially coincides with the output station of the folding unit.

Known transfer units substantially comprise a rotary member having a number of push arms which cooperate with respective packages to push them along the path; and a fixed guide which extends along this path and cooperates with the packages to ease them from the tilted in-feed position to the out-feed position.

Though efficient, packaging machines of the above type leave room for improvement.

As a matter of fact, a wide range of modified package shapes has been developed which are different from the parallelepiped package.

In particular, packages with a slightly rounded or an octagonal cross section have been developed.

For these packages, the Applicant has found that the forming operation may require some adjustments. This is mainly due to the fact that the forming passage must be, in this case, polygonal whereas the endless belts have substantially flat surfaces cooperating with the folded package.

Furthermore, the Applicant has found that these modified packages tend to rotate about their own axis, as they are fed from the in-feed to the out-feed position.

As a result, there is some risk that turned packages stop along the path defined by the transfer unit and causes the stop of the transfer unit and, therefore, of the whole packaging machine.

DISCLOSURE OF INVENTION

It is an object of the present invention to provide a folding unit for a pourable food product machine, designed to provide a straightforward, low-cost solution to at least one of the aforementioned drawbacks, typically associated with the known folding unit.

According to the present invention, there is provided a folding unit for producing folded packages of pourable food products from relative sealed packs, as claimed in claim 1.

The present invention also relates to a method for producing folded packages of pourable food product from relative sealed packs, as claimed in claim 11.

BRIEF DESCRIPTION OF THE DRAWINGS

A preferred, non-limiting embodiment of the present invention will be described by way of example with reference to the accompanying drawings, in which:

FIG. 15 shows in a perspective enlarged view a pack the folding unit of FIGS. 1 to 14 is fed with.

BEST MODE FOR CARRYING OUT THE INVENTION

Figure 1:
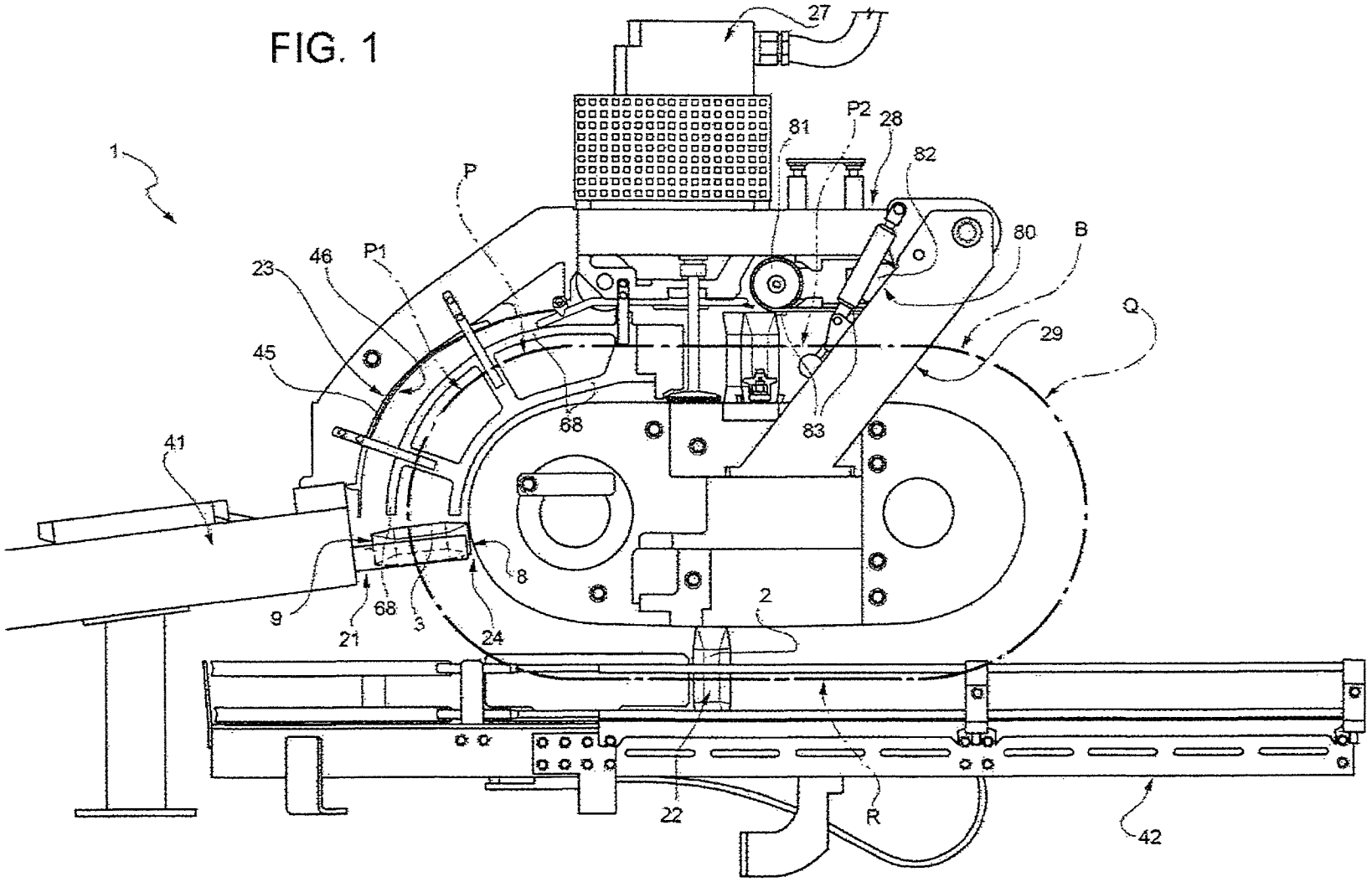
FIG. 1 shows a side view, with parts removed for clarity, of a folding unit in accordance with the present invention for producing folded packages of pourable food products from sealed pillow packs.

Number 1 in FIG. 1 indicates as a whole a folding unit for a packaging machine (not shown) for continuously producing sealed packages 2 of a pourable food product, such as pasteurized or UHT milk, fruit juice, wine, etc., from a known tube of packaging material (not shown).

The tube is formed in known manner upstream from unit 1 by longitudinally folding and sealing a known web (not shown) of heat-seal sheet material, which may comprise a base layer for stiffness and strength, which may be formed by a layer of fibrous material, e.g. paper, or of mineral-filled polypropylene material, and a number of layers of heat-seal plastic material, e.g. polyethylene film, covering both sides of the base layer. In the case of an aseptic package 2 for long-storage products, such as UHT milk, the packaging material may also comprises a layer of gas- and light-barrier material, e.g. an aluminium foil or an ethyl vinyl alcohol (EVOH) foil, which is superimposed on a layer of heat-seal plastic material, and is in turn covered with another layer of heat-seal plastic material forming the inner face of the package 2 eventually contacting the food product.

The tube of packaging material is then filled with the food product for packaging, and is sealed and cut along equally spaced cross sections to form a number of pillow packs 3 (FIG. 15), which are then transferred to unit 1 where they are folded mechanically to form respective packages 2.

Alternatively, the packaging material may be cut into blanks, which are formed into packages 2 with forming spindles, and packages 2 are filled with the food product and sealed. One example of this type of packages is the so-called "gable-top" package known by the trade name Tetra Rex (registered trademark).

In detail, pillow packs 3 are transferred to unit 1 by using an in-feed conveyor 41 (FIG. 1), which is described in more detail in the European application "Feeding unit and method for feeding sealed pillow packs of pourable food products to a folding unit", filed by the Applicant concurrently with the present invention.

Unit 1 also feeds folded package 2 to out-feed conveyor 42, shown in FIG. 1.

Figure 15:
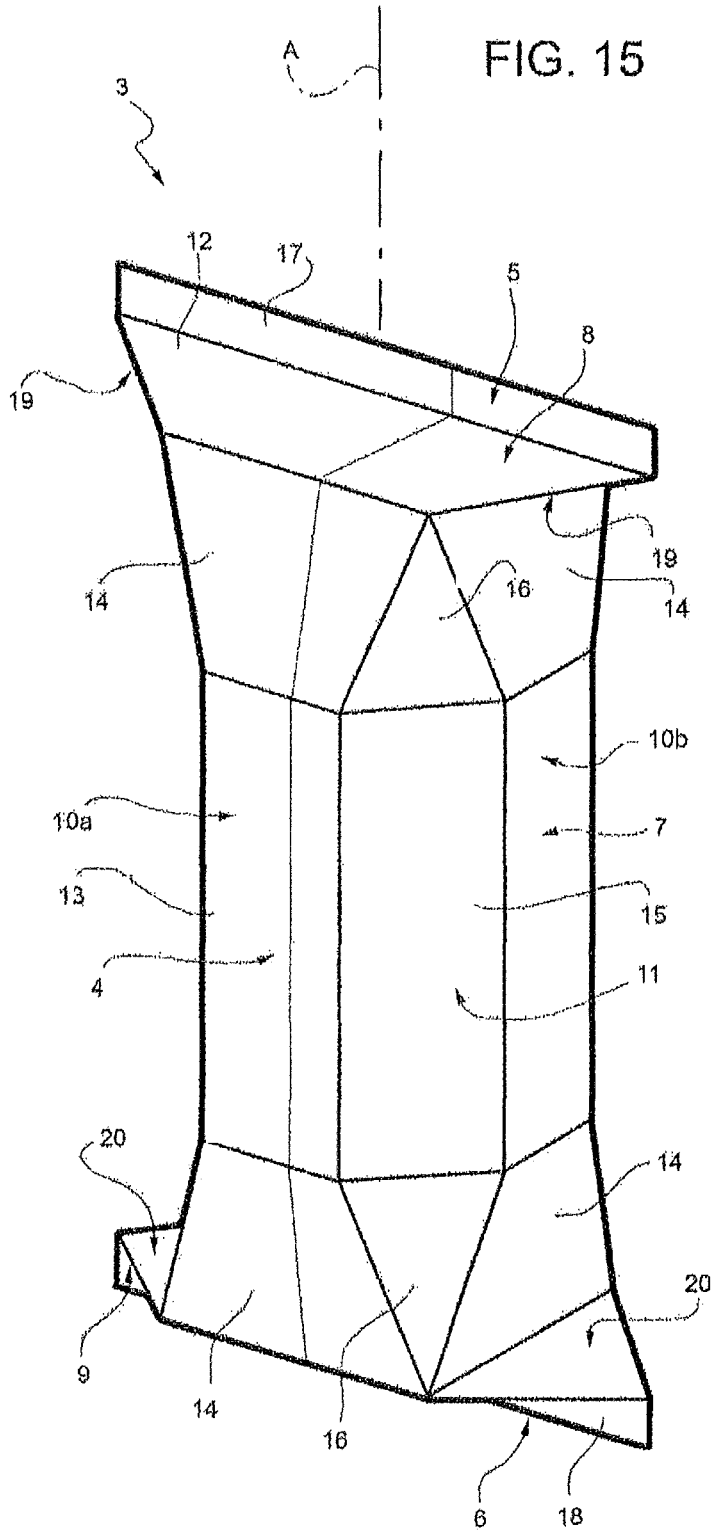

With reference to FIG. 15, an embodiment of a package 2 is shown which has a longitudinal sealing band 4, formed to produce the tube of packaging material from the web folded into a cylinder, extends along one side of each pack 3, which is closed at the opposite ends by respective transverse sealing bands 5, 6 perpendicular to and joined to longitudinal sealing band 4.

Each pack 3 has an axis A, and comprises a main body 7 and opposite, respectively top and bottom, end portions 8, 9 tapering from main body 7 towards respective transverse sealing bands 5, 6.

Main body 7 of each pack 3 is bounded laterally by four lateral walls 10*a*, 10*b* and four corner walls 11 alternate to each other, in the embodiment shown in FIG. 15.

Walls 10*a* (10*b*) are opposite to each other. In the very same way, walls 11 are opposite, in pairs, to each other.

Each wall 10*a*, 10*b* comprises a central rectangular stretch 13 and a pair of opposite, respective top and bottom, end stretches 14 which are interposed between stretch 13 and end portions 8, 9 of pack 3.

In detail, stretches 13 are substantially parallel to axis A. Each end stretch 14 is substantially in the form of an isosceles trapezium, which slopes slightly relative to axis A, and has a major edge defined by respective end portions 8, 9.

Each wall 11 comprises a central rectangular stretch 15 and a pair opposite, respective top and bottom, end stretches 16 which are interposed between stretch 15 and end portions 8, 9 of pack 3.

In detail, stretches 15 are substantially parallel to axis A. Each end stretch 16 is substantially in the form of an isosceles triangle, which slopes slightly relative to axis A and converges from relative stretch 15 towards corresponding end portions 8, 9.

Each end portion 8, 9 is defined by two walls 12, each substantially in the form of an isosceles trapezium, which slope slightly towards each other with respect to a plane perpendicular to axis A, and have minor edges defined by respective end edges of portions 14 of respective wall 10*a*, and major edges joined to each other by respective sealing bands 5, 6.

Longitudinal sealing band 4 extends between transverse sealing bands 5 and 6, and along the whole of one wall 10*a* and the corresponding walls 12 on the same side as wall 10*a*.

Each pack 3 also comprises, for each end portion 8, 9, a respective substantially elongated rectangular end fin 17, 18 projecting in the direction of axis A from relative pack 3; and two substantially triangular flaps 19, 20 projecting laterally on opposite sides of main body 7 and defined by end portions of relative walls 12.

More precisely, each end fin 17, 18 extends along a direction orthogonal to axis A.

To form a package 2, unit 1 presses end portions 8, 9 of relative pack 3 down flat towards each other, and at the same time folds respective fins 17, 18 onto end portions 8, 9.

Furthermore, unit 1 folds flaps 20 onto top stretches 14 of respective walls 10*b* and folds flaps 19 onto previously folded fin 17, on the opposite side of end portion 9.

Figure 2:
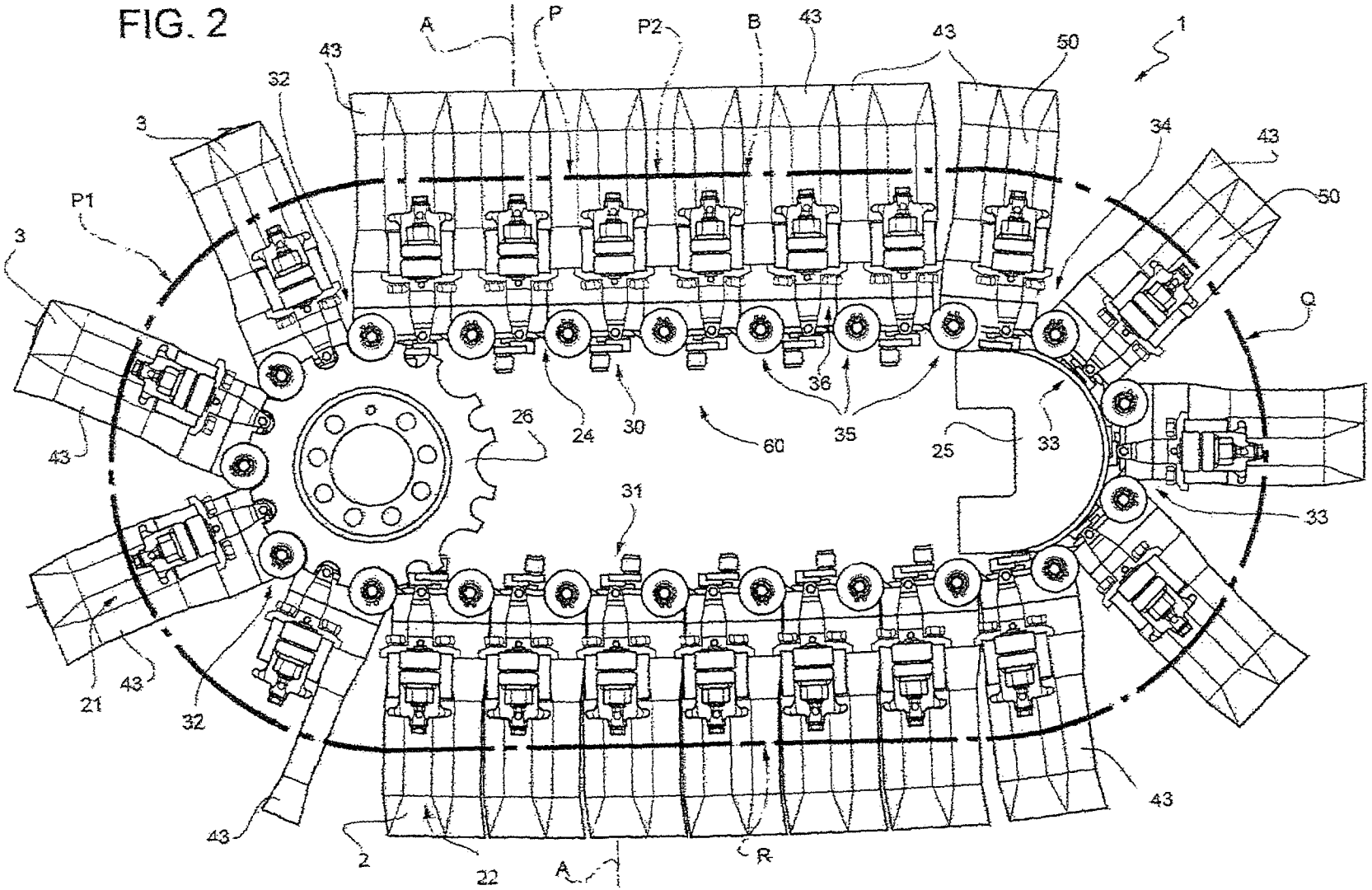
FIG. 2 is an enlarged side view of the folding unit of FIG. 1, with parts removed for clarity.

With reference to FIGS. 1, 2 and 15, unit 1 substantially comprises:

- a frame 29;
- an endless conveyor 34 for feeding packs 3 continuously along a forming path B from a supply station 21 to an output station 22 (both shown only schematically);
- folding means 23 which cooperate cyclically with each pack 3 to flatten end portion 8, fold relative fin 17 onto end portion 8, and fold flaps 19 onto previously flattened end portion 8 on the opposite side of end portion 9;
- folding means 24 for flattening end portion 9, folding relative fin 18 onto portion 9 and bending flaps 20 towards axis A and end portion 9;
- a heating device 27 acting on bent flaps 19, 20 to melt the external layer of the packaging material and seal the flaps 19, 20 before they are pressed against end portion 8 and relative walls 10*b* respectively; and
- a pressing device 28 cooperating with each pack 3 to hold flaps 19 onto flattened fin 17 as flaps 19 cool.

Heating device 27 is, in particular, arranged between folding means 23 and pressure device 28 along forming path B.

With particular reference to FIGS. 2, 4, 5 and 6, conveyor 34 basically comprises an endless transport element, in the example shown a chain 60, formed by a plurality of mutually hinged rigid modules or links 35 and looped about a pair of coaxial driving sprockets 26 and a cam 25.

Chain 60 comprises a straight horizontal top branch 30, a bottom branch 31 substantially parallel to branch 30, and two curved C-shaped portions 32, 33, which are positioned with their concavities facing each other and connect branches 30 and 31; more specifically, C-shaped portion 32 cooperates with driving sprockets 26, whilst C-shaped portion 33 cooperates with cam 25.

Each link 35 comprises a substantially flat plate 36 adapted to receive a relative pack 3, and a paddle 43, which projects perpendicularly from plate 36 on the opposite side of driving sprockets 26 and cam 25 and which cooperates with and pushes a corresponding wall 10 of a relative pack 3 to feed it along path B.

Cam 25 is described in more detail in the European application "Folding unit for producing folded packages of pourable food products from relative sealed packs", filed by the Applicant concurrently with the present invention.

Figure 5:
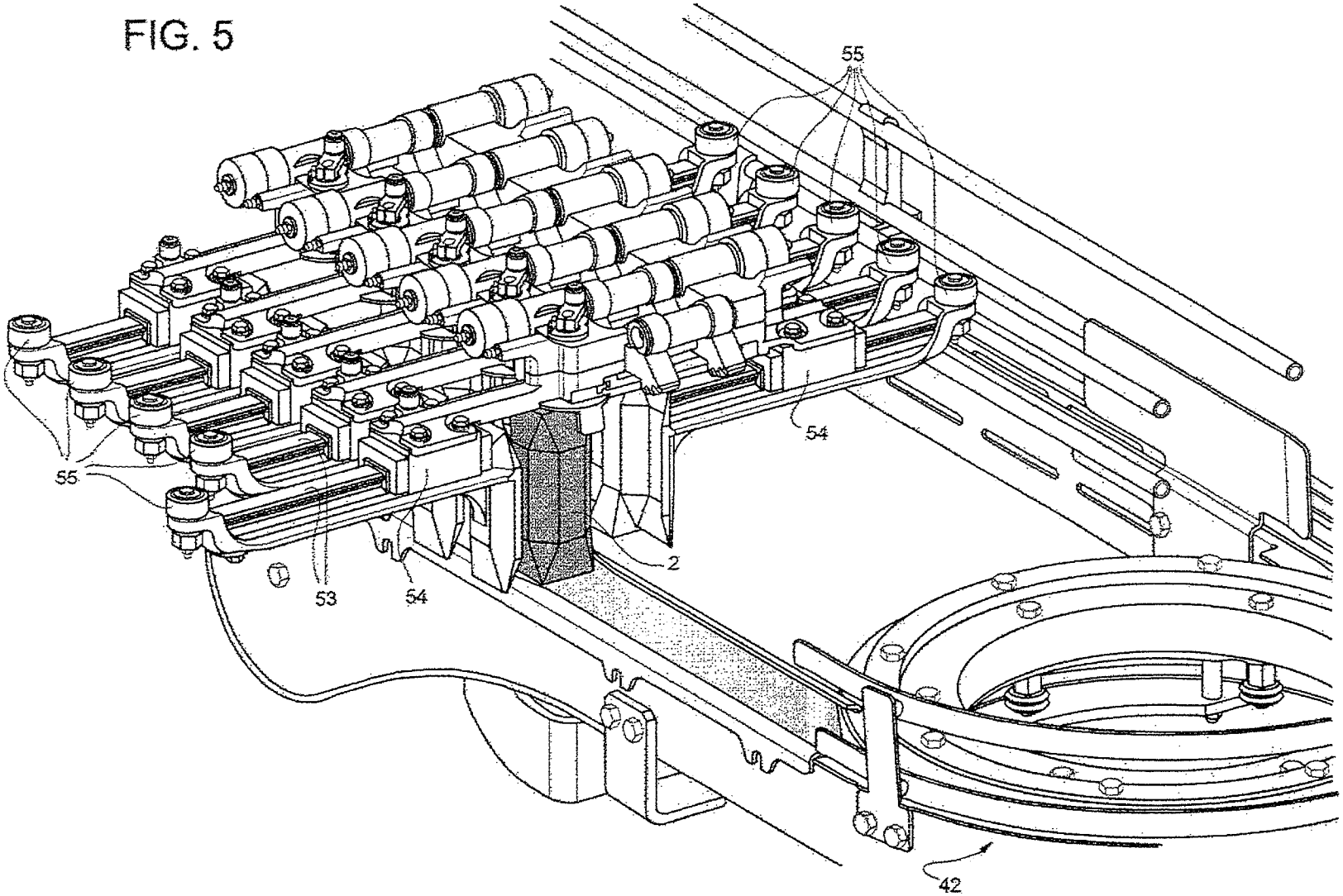
FIG. 5 shows a perspective view, with parts removed for clarity, of the bottom part folding unit of FIGS. 1 to 4.
Figure 6:
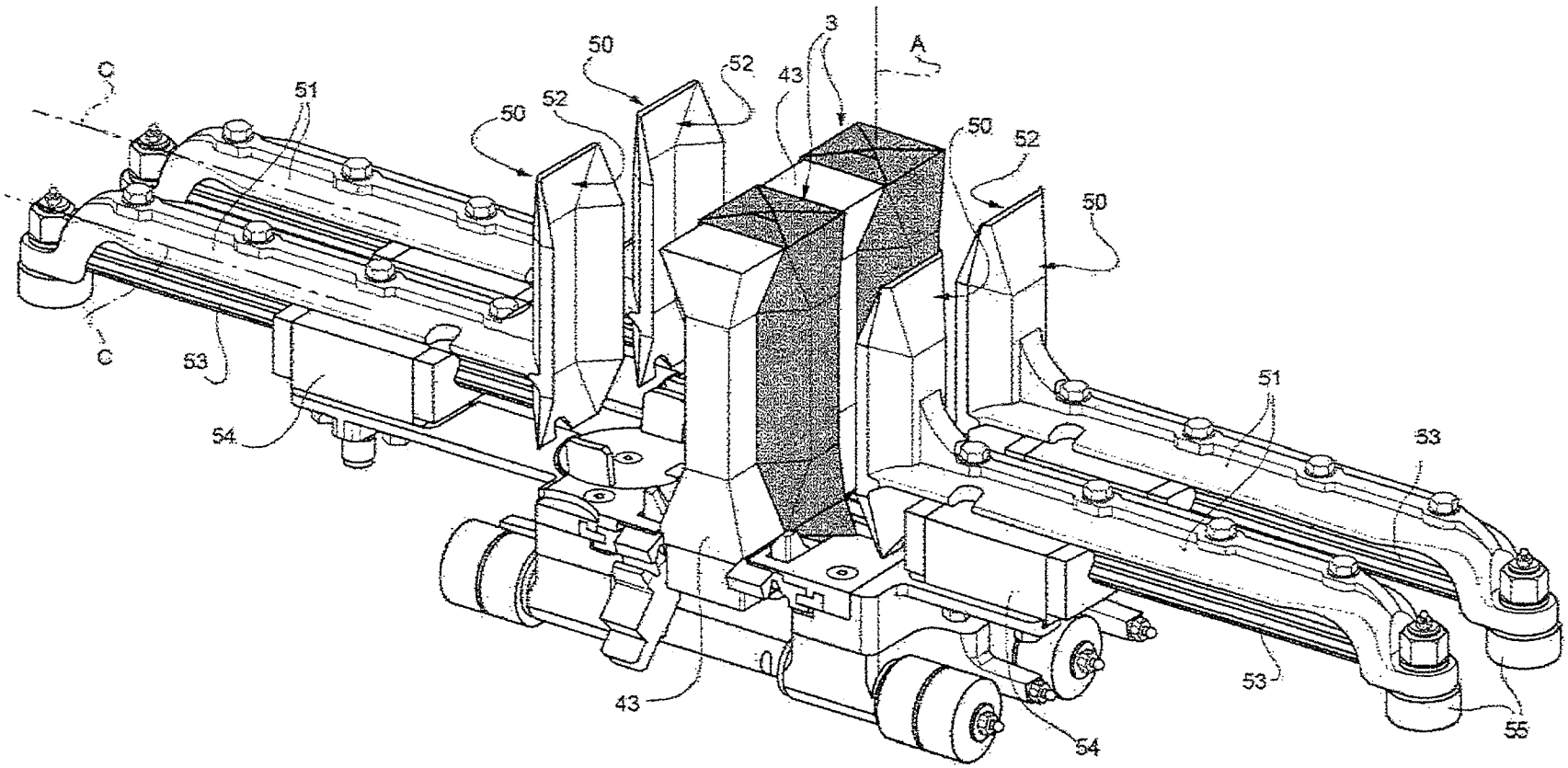
FIGS. 6 to 10 show some components of the unit of FIGS. 1 to 5 in different operative conditions.
Figure 7:
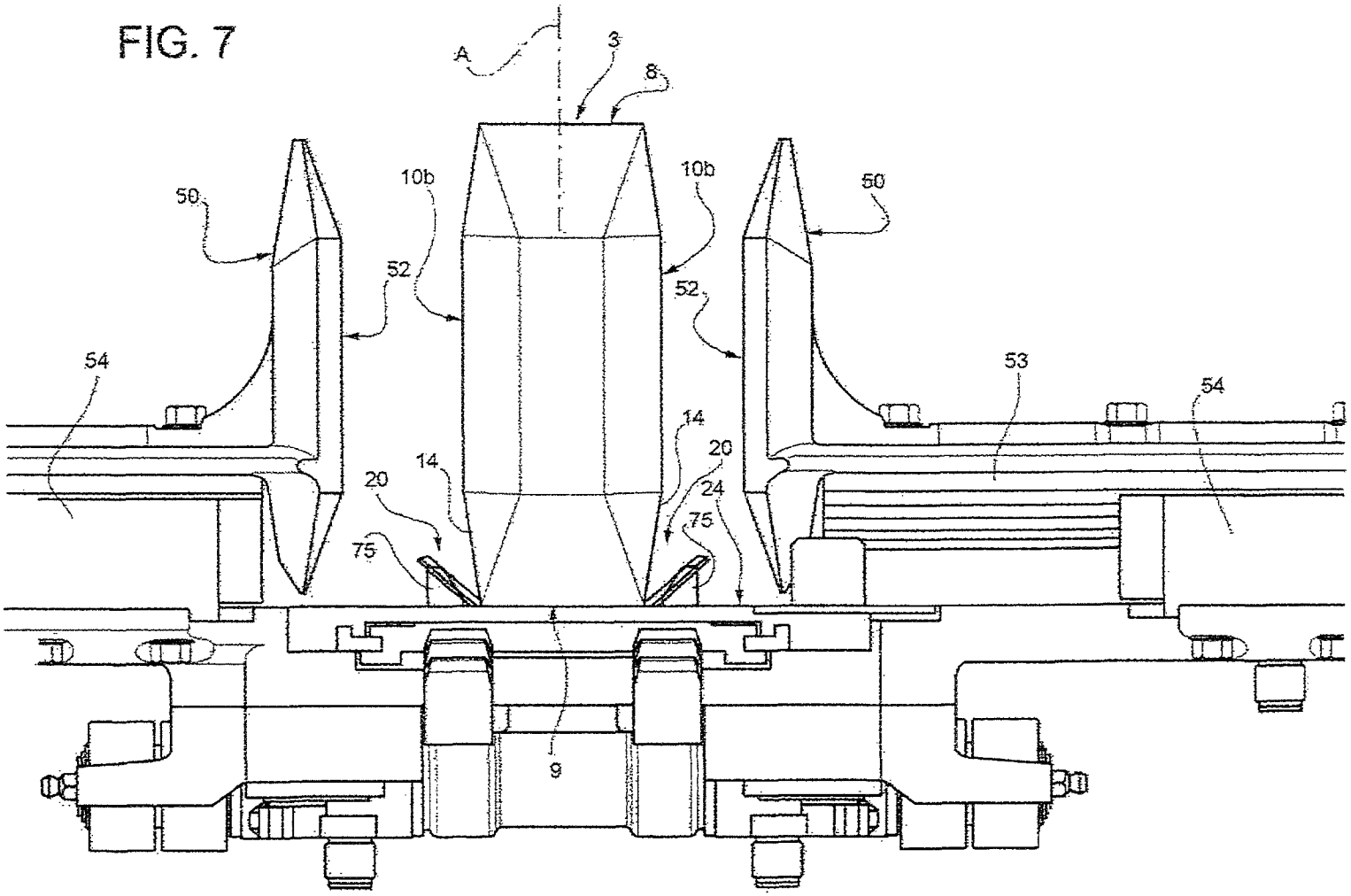

Advantageously, unit 1 comprises (FIGS. 5 and 6) a plurality of pairs of shells 50 which are integrally movable along path B and are movable along a direction C transversal to path B; shells 50 of each pair may be arranged in:

- a fully closed position in which they exert a pressure onto a relative pack 3, so as to complete a folding operation thereon; and
- an open position in which they are detached from folded package 2 (FIGS. 5 and 6).

Furthermore, shells 50 may be arranged also in a closed position, in which they grip folded package 2 but substantially do not exert any pressure thereon.

In detail, station 21 is defined by C-shaped portion 32 and station 22 is defined by bottom branch 31 in a position closer to C-shaped portion 32 than to C-shaped portion 33.

Path B comprises, proceeding from station 21 to station 22:

- a portion P starting from station 21, comprising a curved and a straight stretches P1, P2, along which packs 3 are folded into relative packages 2;
- a curved portion Q along which folded packages 2 are overturned of 180 degrees; and
- a straight portion R arranged downstream from curved portion Q and upstream from station 22.

In detail, stretch P1 is defined by a part of C-shaped portion 32 and stretch P2 is defined by top branch 30 of chain 60. Portion Q is defined by C-shaped portion 33, and portion R is defined by part of bottom branch 31 of chain 60.

Folding means 23 cooperate cyclically with each pack 3 along portion P.

Folding means 24 are defined by links 35 and, therefore, move together with chain 60 along path B.

Figure 8:
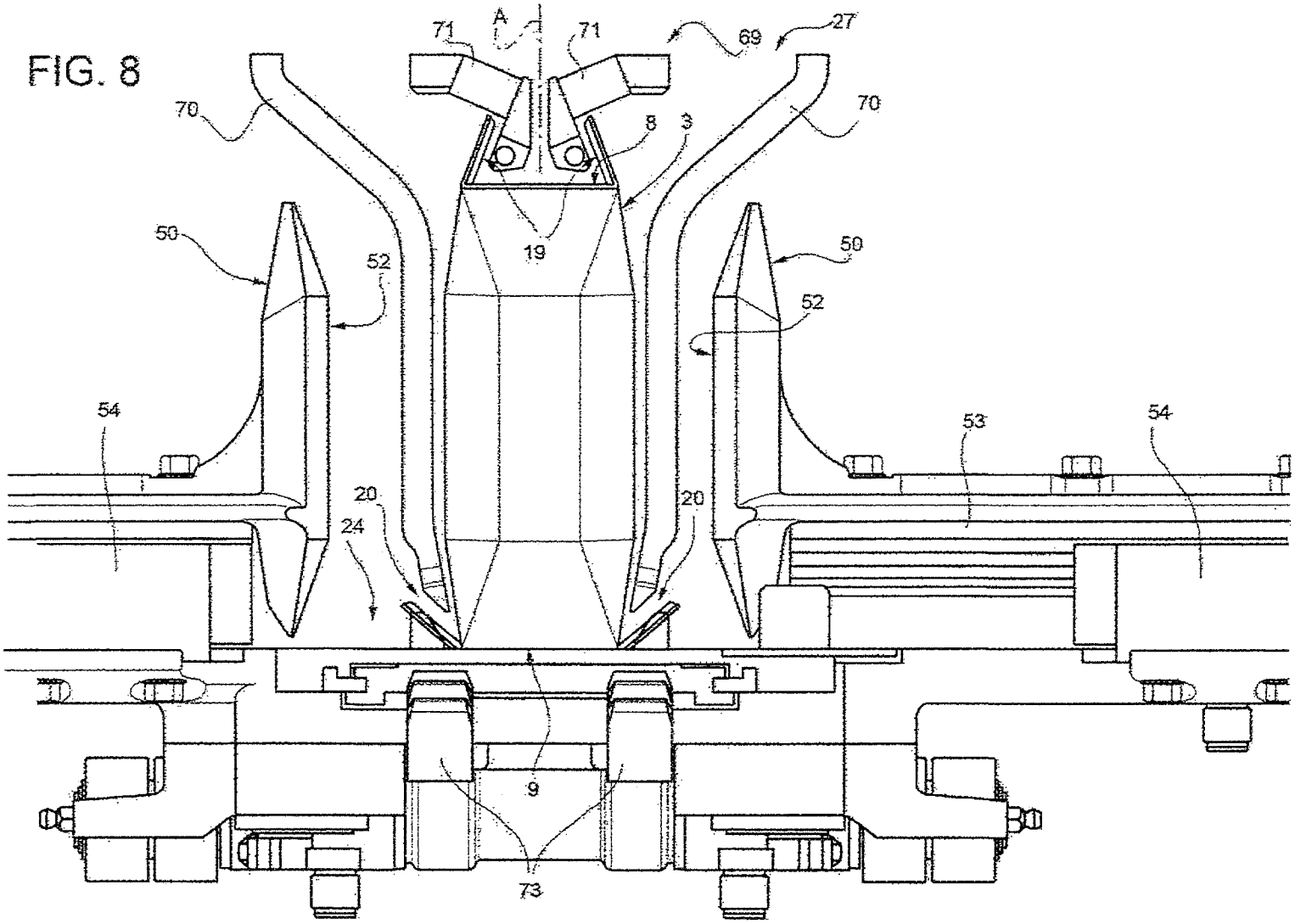

In detail, folding means 24 flatten end portion 9, folds relative fin 18 onto portion 9 and bend flaps 20 towards axis A and end portion 8, as relative pack 2 is carried along stretch P1 of path P (FIG. 8).

Figure 9:
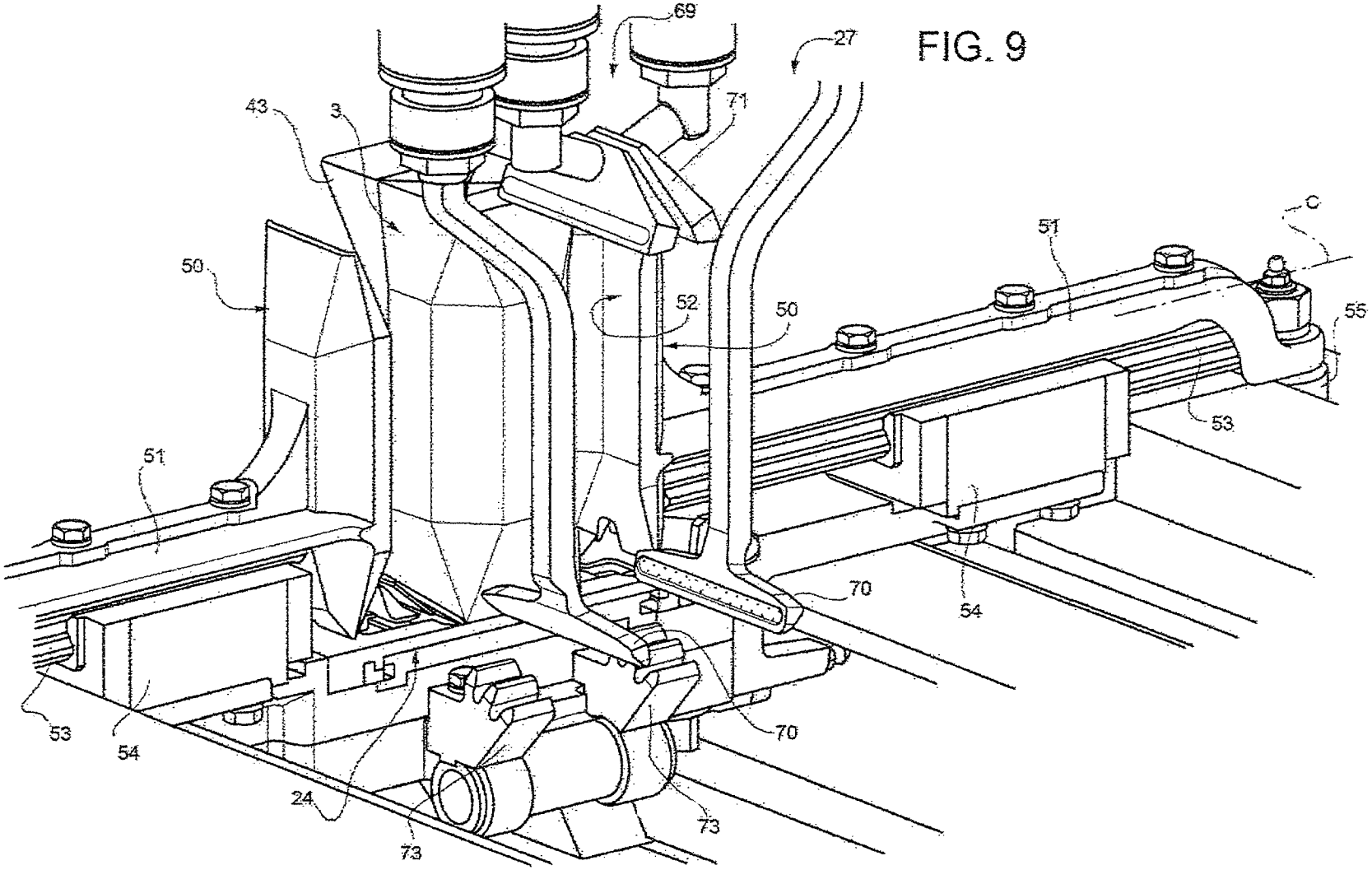
Figure 10:
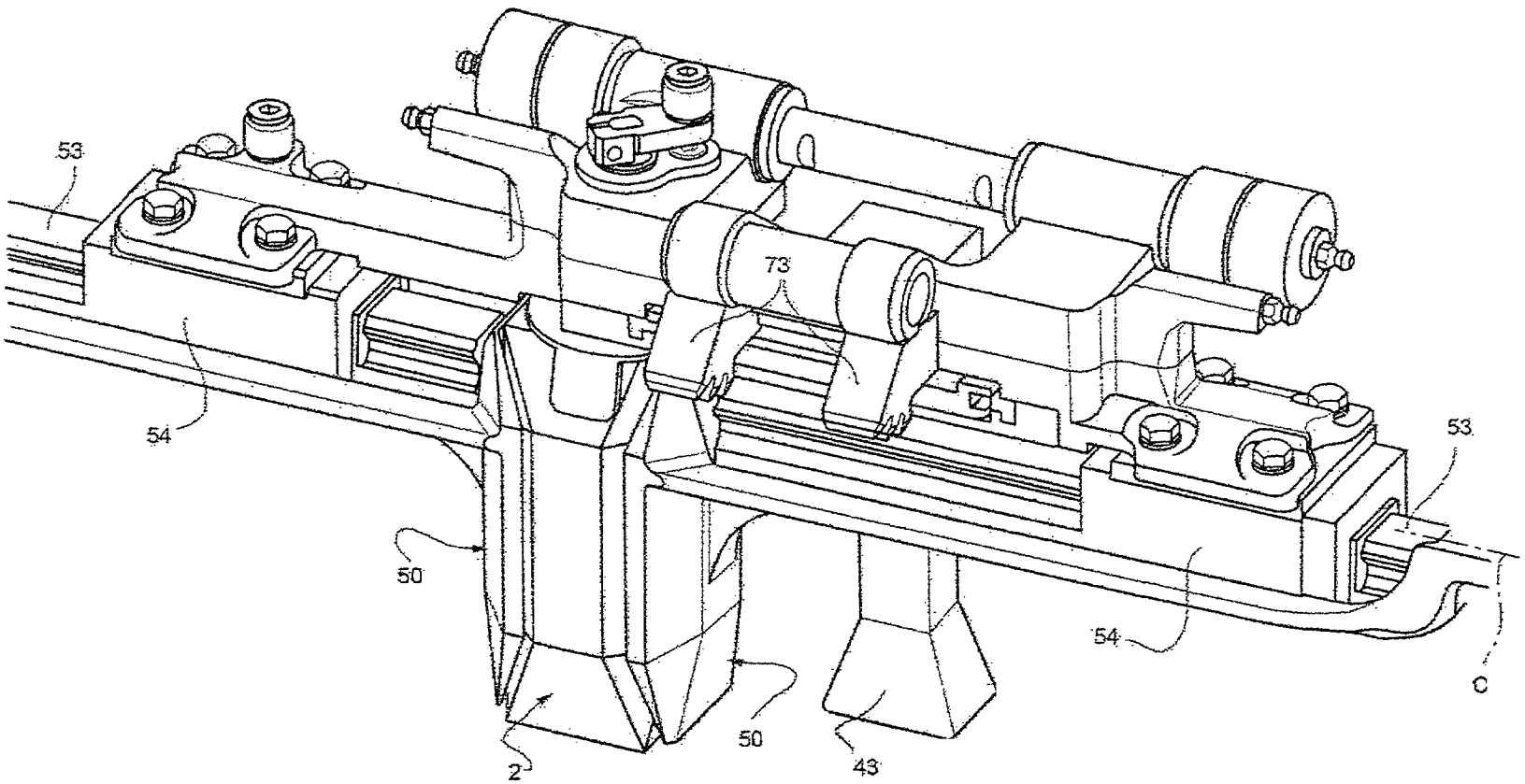

Heating device 27 acts on bent flaps 19, 20 to melt the external layer of the packaging material and seal the flaps 19, 20 before they are pressed against end portion 8 and relative walls 10*b* respectively, as pack 2 is carried along stretch P2 of portion P (FIG. 9).

In detail, shells 50 of each pair cyclically move according to the following work cycle.

Shells 50 of each pair are arranged in the open position at station 21, move from open to fully closed position along stretch P1 and an initial part of stretch P2, and reach the fully closed position along a remaining part of stretch P2. In the embodiment shown, shells 50 reach the fully closed position downstream from heating device 27 and upstream from pressing device 28, proceeding according to the advancing direction of chain 60.

When shells 50 are arranged in the fully closed position they exert a certain pressure on relative walls 10*b* and 11 adjacent thereto.

More precisely, as moving between the open and the fully closed position along stretch P2 of portion P, shells 50 of each link 35 perform two functions:

- firstly, they complete the bending of flaps 20 onto top stretches 14 of relative walls 10*b*; and then, they press flaps 20, which have been previously bent and heated, onto stretches 14 of relative walls 10*b*.

Furthermore, shells 50 of each pair move from the fully closed position into the closed position at the beginning of portion Q.

Along portion Q, shells 50 integrally move parallel to direction C and relative to respective paddle 43 (FIG. 6).

In the embodiment shown, shells 50 move away relative to each other for a distance, for example, of 2-4 mm, when they move from the fully closed position to the closed position.

In the following of the present description, only one link 35 will be described in detail, being clear that all links 35 are identical to each other.

Figure 12:
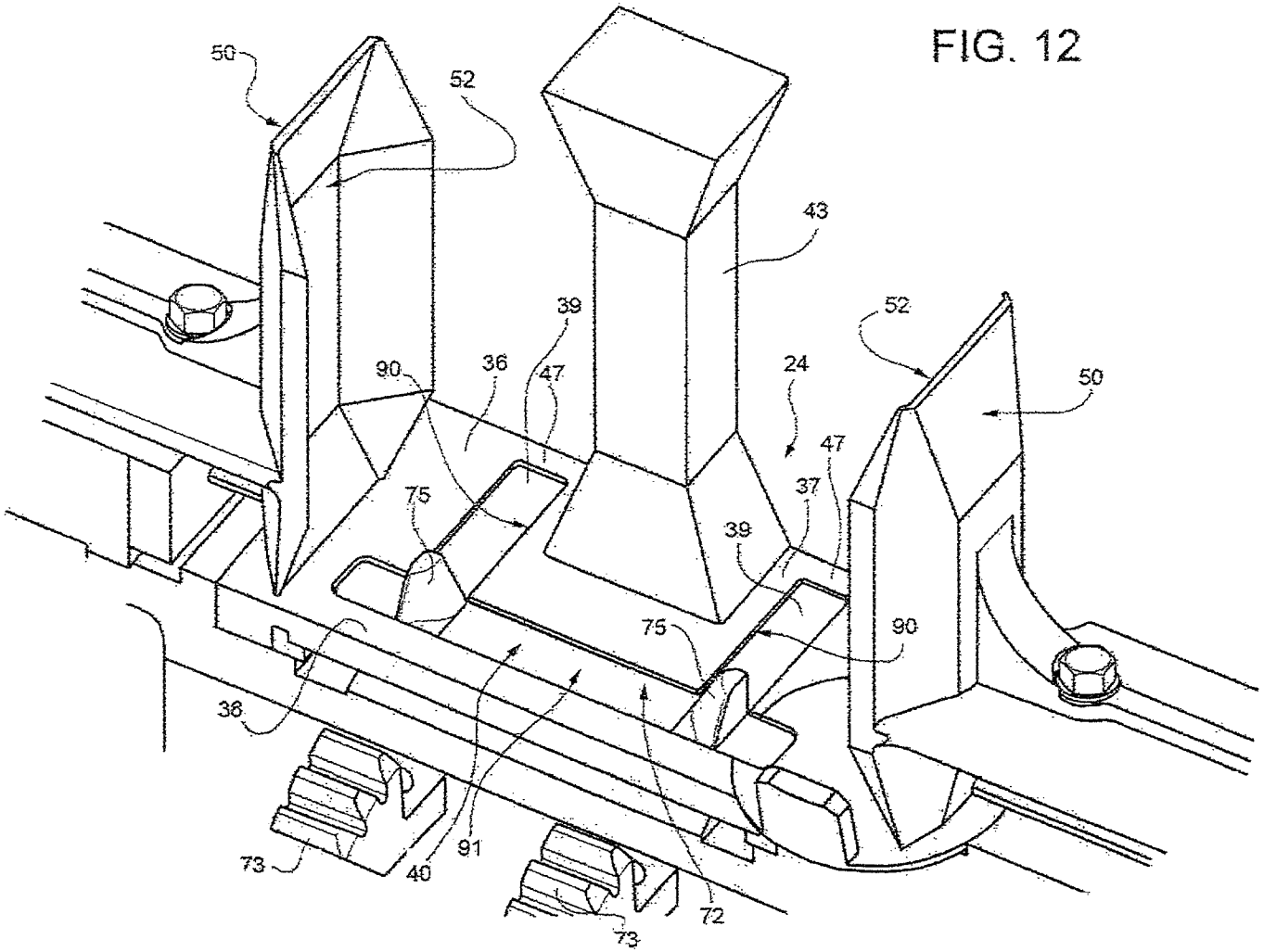
Figure 13:
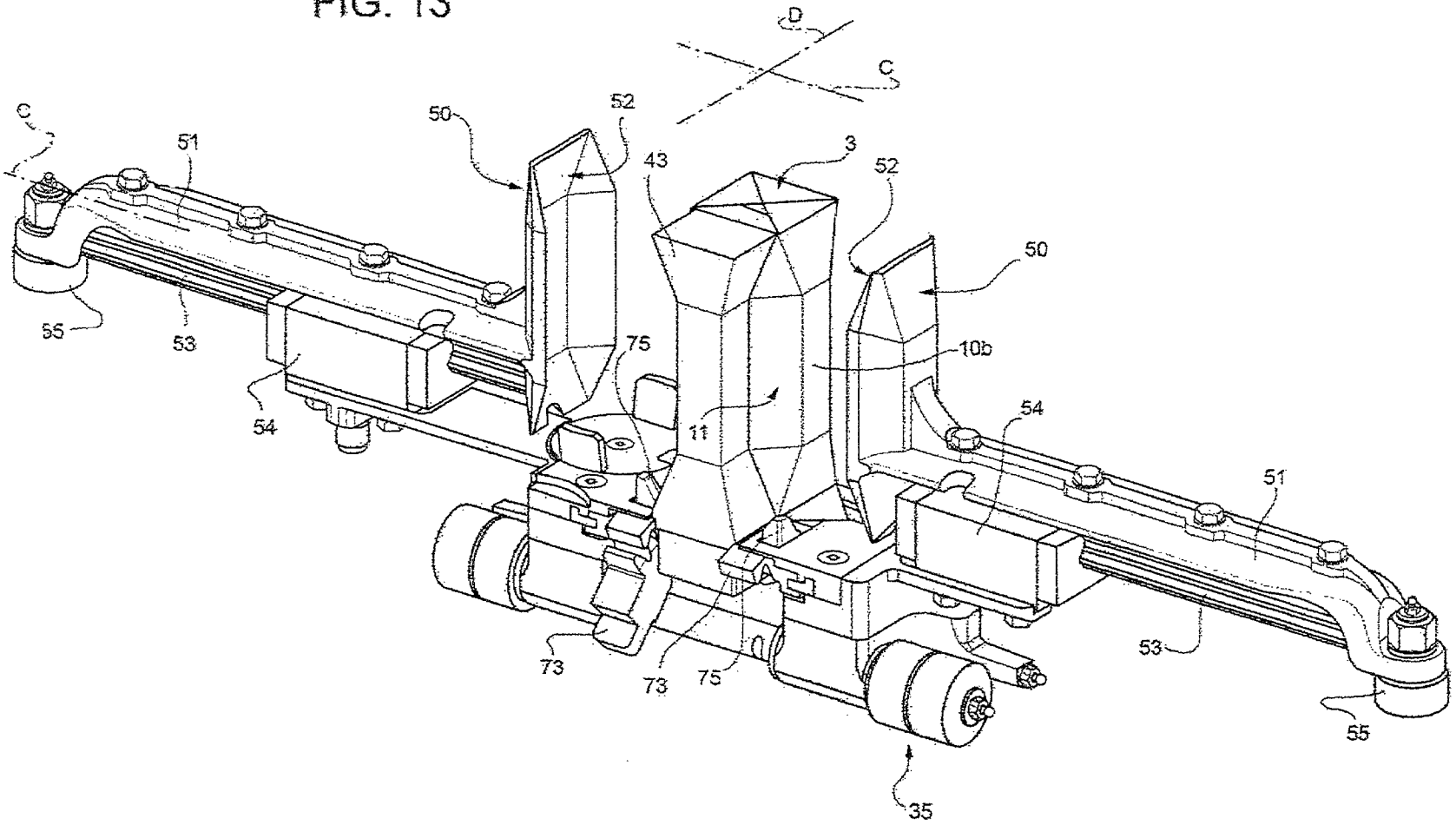
Figure 14:
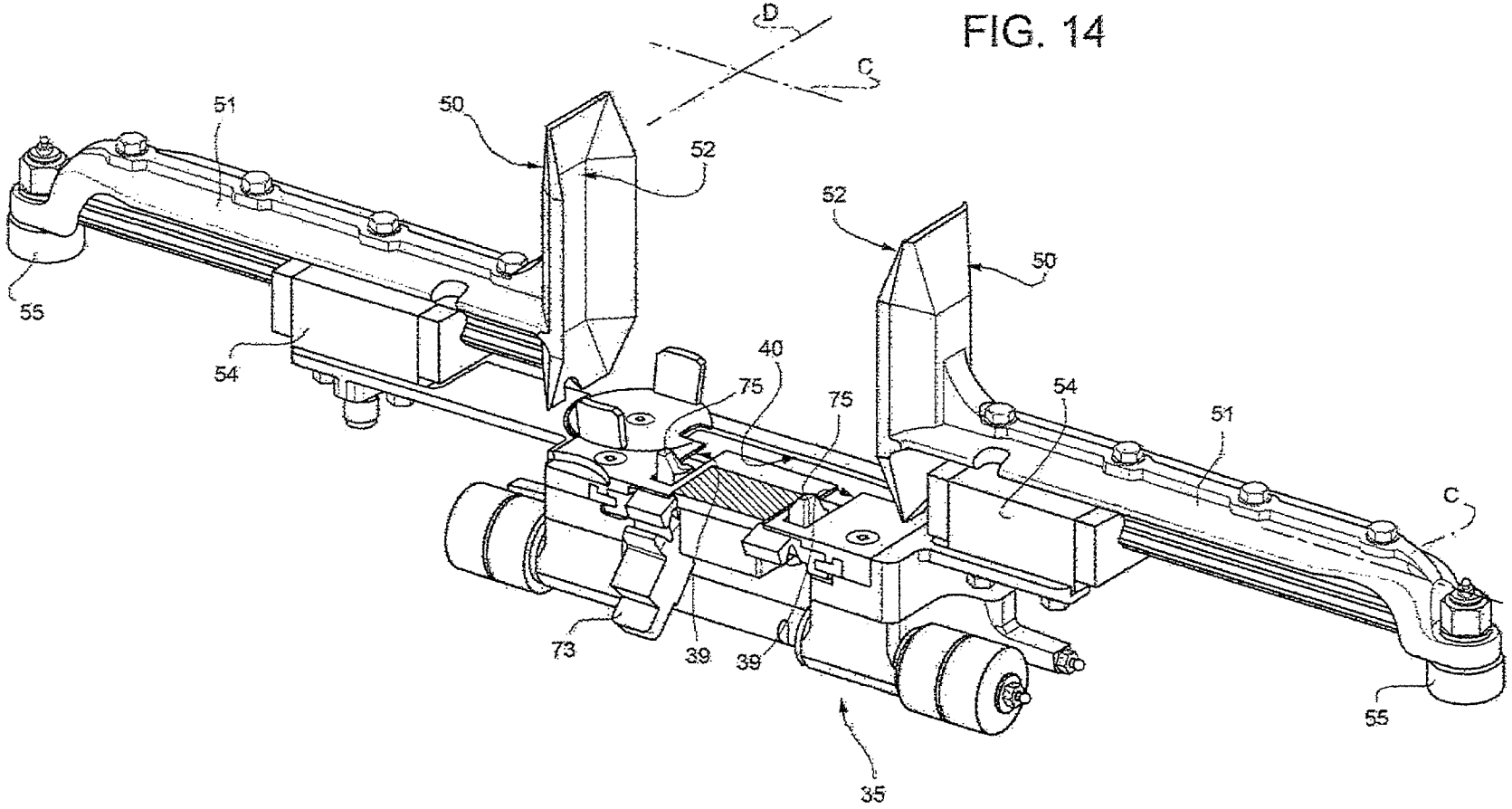

Link 35 comprises (FIGS. 12 to 14):

plate 36;

paddle 43;

a pair of shells 50 which may move relative to paddle 43 along direction C;

a pair of arms 51 connected to relative shells 50, elongated parallel to direction C and comprising each a relative slide 53; and a pair of guides 54 which extend on opposite sides of relative paddle 43 along direction C, and relative to which slides 53 move parallel to direction C.

Referring again to FIGS. 1 and 2, plate 36 is arranged below, and then support, pack 3 (or package 2) along portion P and a starting stretch of portion Q of forming path B.

Conversely, plate 36 is arranged above package 2 along portion R of forming path B. Accordingly, folded package 2 is released, under the gravity action at station 22, to conveyor 42.

Shells 50 define, on their sides opposite to arm 51, relative surfaces 52 which are adapted to cooperate with pack 3 and which face each other.

Surfaces 52 mirror the lateral surface of packages 2 to be folded, so as to control the final shape of packages 2.

In the embodiment shown, each surface 52 mirrors a relative walls 10*b* and parts of relative walls 11.

Each arm 51 comprises, on its end opposite to relative shell 50, a roller 55.

Each slide 53 is arranged between relative shells 50 and rollers 55 of relative arm 51. Furthermore, each slide 53 may slide parallel to direction C relative to guide 54.

In the embodiment shown, each arm 51 is integral with relative shell 50.

Paddles 43 mirror the shape of walls 10 and of the part of relative walls 11 they cooperate with.

Plate 36 of link 35 comprises (FIGS. 12 and 13):

a rectangular portion 37 from which paddle 43 protrudes; and a contoured portion 38 which surrounds portion 37.

Plate 36 of link 35 also defines:

a pair of through slots 39 which are arranged on opposite lateral sides of paddle 43 and elongated along a direction D tangent to forming path B and orthogonal to direction C; and a through slot 40 which is in communication with slots 39, is arranged downstream from slots 39 and portion 37 proceeding according to the advancing direction of chain 60, and which extends parallel to direction C.

Slots 39 are arranged on lateral sides of portion 37 and slots 39, 40 are defined between portions 37, 38.

Slots 39 extend, along direction D, between slot 40 and relative bridges 47 which integrally connect portions 36, 37.

Slot 40 extends parallel to direction C.

Folding means 24 comprises, for each link 35:

plate 36 which is integrally movable with paddle 43 along forming path B; and a C-shaped movable plate 72 which may move along direction D relative to paddle 43 and plate 36 between a first position (FIG. 12) in which it engages slot 40, so as to fold end fin 18 housed therein, and a second position (FIG. 13) in which it leaves free slot 40.

In particular, slot 40 remains open when plate 72 is in the second position.

Link 35 also comprises a pair of toothed sectors 73 staggered along relative direction C and which protrude from link 35 downstream from plate 36, proceeding according to the advancing direction of chain 60.

Plate 72 integrally comprises two arms 90 arranged on lateral sides of paddle 43, and a central element 91 interposed between arms 90.

Each arm 90 comprises a wedge 75 arranged on the side of paddle 43 and a rack 76 (FIG. 11) arranged on the side of cam 25 and driving sprocket 26.

Element 91 is housed within slot 40 when plate 72 is in the first position, and is arranged upstream from slot when plate 72 is in the second position.

In the embodiment shown, wedges 75 are triangular in cross section and converge towards a mid-direction of link 35.

Wedges 75 are arranged downstream from racks 76, proceeding according to an advancing direction of chain 60.

Figure 11:
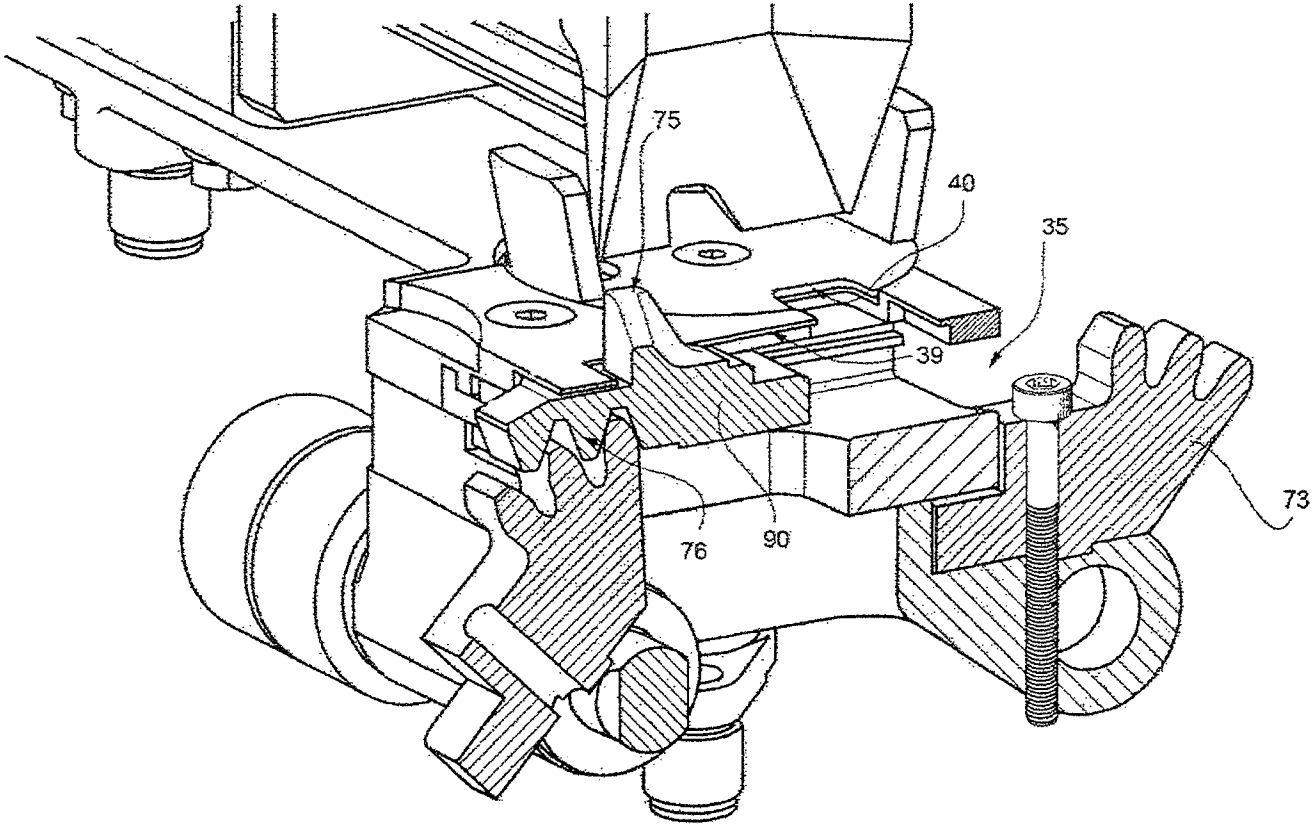
FIGS. 11 to 14 are perspective views of further components of the folding unit of FIGS. 1 to 5.

Toothed sectors 73 of each link 35 mesh with racks 76 of the following link 35, proceeding along the advancing direction of chain 60 (FIG. 11).

Plate 72 is arranged in the second position at station 21, moves from the second to the first position along stretch P1 of path B, remains in the first position along stretch P2 of path B, moves from the first to the second position along portion Q of path B, and remains in the second position along portion R of path B and from station 22 to station 21.

More precisely, fin 18 of pack 3 is arranged within open slot 40 of link 35 at station 21. When plate 72 of link 35 moves in the first position and engages slot 40, fin 18 is folded onto end portion 8. At the same time, wedges 75 raise flaps 20 towards end portion 8 and bend flaps 20 relative to axis A, up to when they reach the position shown in FIG. 8.

The corresponding shells 50, as moving from the open to the fully closed position, press flaps 20 against top stretches 14 of relative walls 12, downstream from folding means 23 and heating device 17, proceeding according to the advancing direction of chain 60.

Unit 1 also comprises a pair of cams 61 (FIGS. 3 and 4) adapted to control the movement of each pair of shells 50 between relative fully closed position, closed position and open position, as each pair of shells 50 advances along path B.

Furthermore, cams 61 also control the movement of each pair of shells 50 integrally to each other along direction C and relative to paddle 43 of corresponding link 35.

In detail, cams 61 are arranged on opposite lateral sides of chain 60.

One cam 61 comprises a groove 62 which is engaged by rollers 55 of first shells 50.

The other cam 61 comprises a further groove 62 which is engaged by rollers 55 of second shells 50.

Figure 3:
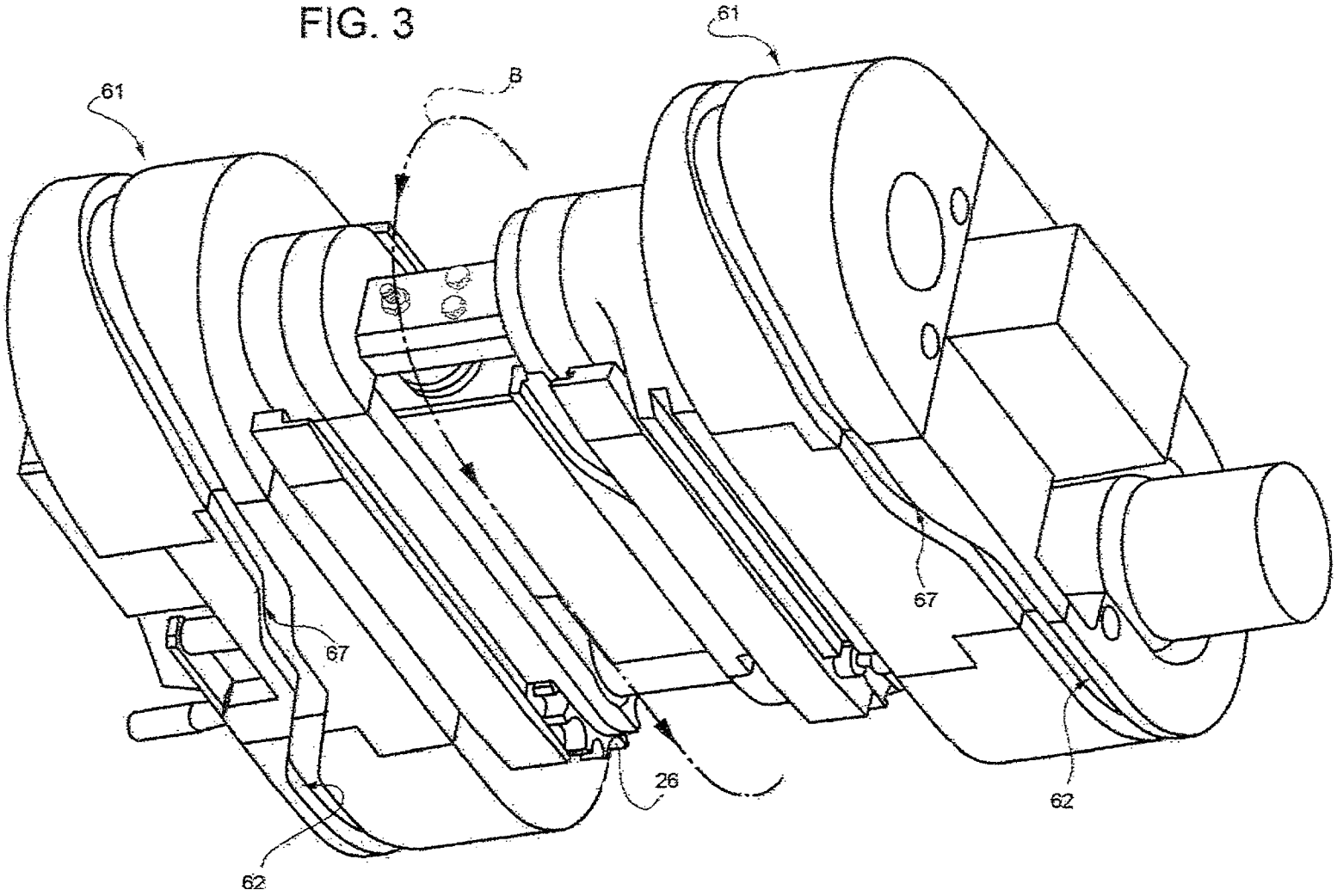
FIGS. 3 and 4 show respectively bottom and top perspective views, with parts removed for clarity, of the folding unit of FIG. 2.
Figure 4:
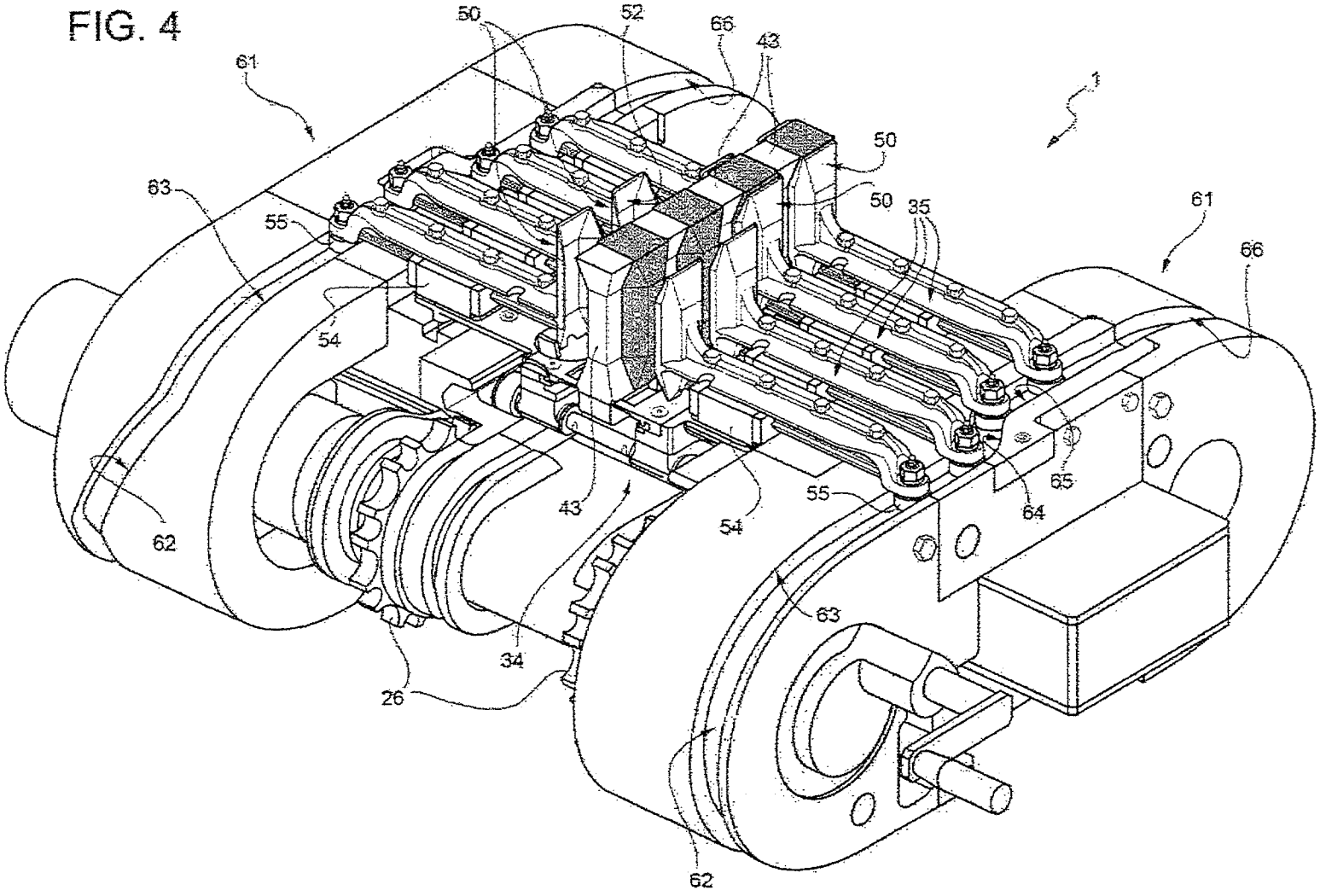

With reference to FIGS. 3 to 5, grooves 62 comprise, proceeding from station 21 to station 22:

relative straight portions 63 which are adapted to keep shells 50 of each pair in the open position;

relative converging portions 64 which are adapted to move shells 50 from relative open to relative fully closed portion along stretch P2 of path P;

relative straight portions 65 which are adapted to keep shells 50 of each pair in respective fully closed position;

relative curved portions 66 which are adapted to move shells 50 from respective fully closed to respective closed positions; curved portions 66 also move corresponding shells 50 with respect to corresponding paddle 43 and parallel to respective directions C; and relative curved portions 67 which are adapted to move shells 50 from respective closed to respective open positions.

Folding means 23 comprise a guide member 45 fitted in a fixed position between station 21 and heating device 27 (FIG. 1).

Guide member 45 defines a contrast surface 46 (FIG. 1) converging towards chain 60 and cooperating in a sliding manner with end portion 9 of each pack 3 to compress and flatten end portion 9 towards chain 60.

Frame 29 also comprises a pair of fixed sides 68 (only one shown in FIG. 1) for laterally containing packs 3 along path B, located on opposite sides of chain 60, and extending between station 21 and heating device 27.

Heating device 27 comprises (FIGS. 1, 8 and 9):

an assembly air device 69 fitted to frame 29;

a pair of first nozzles 70 connected to assembly 69 and adapted to direct hot air onto flaps 20 of each pack 3 before each pack 3 reaches final pressing device 28; and a pair of second nozzles 71 connected to assembly 69 and adapted to direct hot air onto flaps 19 of each pack 3 before a relative pair of shells 50 reaches the fully closed position.

Pressure device 28 comprises (FIG. 1) a belt 80 wound onto a drive wheel 81 and a driven wheel 82. Belt 80 comprises, on its outer surface opposite to wheels 81, 82, a plurality of projections 83 which are adapted to press flaps 19 of each pack 3 onto relative fin 17.

The volume of each package 2 in formation is controlled, downstream from heating device 27, within a compartment bounded by:

paddles 43 of relative link 35 and of the link 35 arranged immediately downstream proceeding according to the advancing direction of chain 60;

shells 50 of relative link 35 which are arranged in the fully closed position; and plate 72 of relative link 35 arranged in the second position; and belt 80.

Operation of unit 1 will be described with reference to one pack 3 and to relative link 35 as of an initial instant, in which pack 3 is fed from the in-feed conveyor to chain 60 at station 21 of path B.

In this condition, link 35 is moving at the beginning of stretch P1 and therefore slot 40 is open. Furthermore, shells 50 are arranged in the open position.

In detail, pack 3 is positioned with end fin 18 facing plate 72 of link 35, and slides on one wall 10*a* along relative paddle 43, so that fin 18 is parallel to paddle 43, until when fin 18 enters open slot 40.

In this condition, pack 3 is arranged above and, therefore, supported by plate 36 of link 35.

As link 35 moves along stretch P1 and a portion of stretch P2, contrast surface 46 cooperates in a sliding manner with end portion 8 of pack 3. In this way, portions 8 and 9 are flattened towards each other, fin 17 is folded onto portion 8 and flaps 20 are bent relative to portion 8 towards axis A and on the opposite side of portion 8, as shown in FIG. 9.

At the same time, each pair of consecutive links 35 moves towards each other along stretch P1. In this way, racks 76 of the subsequent link 35 are thrust by toothed sectors 73 of the precedent link 35, proceeding according to the advancing direction of chain 60 along stretch P1 of forming path B.

Accordingly, plate 72 of the subsequent link 35 moves from the second to the first position, in which it engages slot 40.

As plate 72 engages slot 40, fin 18 is folded onto end portion 9. Simultaneously, wedges 75 raise flaps 20 towards end portion 8 and bend flaps 20 relative to axis A, as shown in FIGS. 8 and 9.

As link 35 moves along stretch P2, shells 50 move from the open position to the fully closed position and plate 72 are arranged in the first position.

Before shells 50 reach pack 3, nozzles 70, 71 direct air onto flaps 19, 20 of pack 3, to partly and locally melt the packaging material of flaps 19, 20 (FIG. 9).

Immediately after, shells 50 contact walls 10*b*, 11 of packs 3, and press flaps 20 onto relative top stretches 14 of walls 11 as flaps 20 cool. In this condition, shells 50 are arranged in the fully closed position.

Subsequently, pack 3 is arranged below belt 80 and projections 83 press flaps 20 onto portion 9, as flaps 20 cool.

In this condition, the volume of folded package 2 is controlled by two paddles 43 of respective consecutive links 35, by shells 50 arranged in the fully closed position, and by projections 83 of belt 80.

Folded package 2 then move along portion Q of path P.

Along portion Q, shells 50 move relative to each other from the fully closed to the closed position, in which they grip package 2 but substantially do not exert any pressure thereon.

Furthermore, shells 50 move together with package 2 relative to paddle 43 parallel to direction C, along portion Q.

In this way, shells 50 together with folded package 2 are staggered from paddle 43, at the end of portion Q.

Along portion Q, each pair of consecutive links 35 move away from each other. In this way, racks 76 of the subsequent link 35 move away from toothed sectors 73 of the precedent link 35.

Accordingly, plate 72 of the subsequent link 35 moves back from the first to the second position, in which it leaves free slot 40.

Finally, folded package 2 and shells 50 arranged in the closed position are conveyed along portion R.

It is important to mention that during the descending stretch of portion Q and along portion R of path B, folded package 2 is arranged below plate 36 and is supported by the shells 50 arranged in the closed position.

At station 22, shells 50 move back to the open position and package 2 is released, under the gravity action, to the out-feed conveyor.

Being staggered relative to shells 50 and package 2, paddle 43 does not interfere with the release of package 2.

Subsequently, shells 50 are conveyed by chain 60 towards station 21.

The advantages of unit 1 and of the method according to the present invention will be clear from the foregoing description.

In particular, shells 50 are in the closed position when the forming of relative package 2 is completed. In this way, surface 53 of shells 50 are active in controlling the shape of package 2 in formation.

As a result, the forming of packages 2 is highly precise and repeatable, even when package 2 has a round or polygonal cross-section.

Furthermore, folded packages 2 are held by shells 50 along portion R of path B, in which packages 2 are below relative plates 36.

In this way, packages 2 are vertical when they are directly discharged on out-feed conveyor 42 under the gravity action.

As a result, there is no need of a transfer unit between folding unit and out-feed conveyor 42.

Accordingly, there is no longer any risk that packages 2 may stop within the transfer unit, regardless the shape of packages 2.

Finally, shells 50 may move with respect to relative paddle 43 along portion Q and parallel to direction C.

In this way, shells 50 and relative packages 2 are staggered from relative paddle 43, along portion Q of path B and at station 22.

Accordingly, there is no risk that paddle 43 of each link 35 interferes with relative package 2 to be discharged at station 22.

Clearly, changes may be made to unit 1 and to the method without, however, departing from the protective scope defined in the accompanying Claims.

In particular, unit 1 could comprise a rotating device for rotating packages 2 before they are released at station 22.

Unit 1 could comprise only one cam 61.

The invention claimed is:

1. A folding unit for producing folded packages of pourable food products from respective sealed packs, each of said sealed packs including an unfolded portion, said folding unit comprising:

movable conveying means which are fed with a plurality of said sealed packs at an input station to feed said sealed packs along a forming path and output said folded packages at an output station, the movable conveying means moving along a closed loop which includes the forming path, the input station and the output station;

folding means cooperating with each said sealed pack to perform at least one folding operation on said unfolded portion of said sealed pack while said sealed pack is in the forming path, said at least one folding operation performed by said folding means leaving an unfolded end flap of said sealed pack;

at least one pair of shells, the shells of the at least one pair of shells being integrally movable in conjunction with one another along said closed loop, and the shells of the at least one pair of shells being movable relative to each other along a transverse direction transverse to said forming path, each of the at least one pair of shells being conveyed by the conveying means to move along the entirety of the closed loop;

said shells of each of said at least one pair of shells being integrally movable in the transverse direction so that both of said shells move in the same direction in conjunction with one another in the transverse direction; and said shells of the pair of shells being settable along said transverse direction at least in:

a fully closed position in which the shells exert a pressure onto one of said sealed packs, so as to at least complete a folding operation on said sealed pack by contacting and folding said unfolded end flap of said unfolded portion of said sealed pack; and an open position in which the shells are detached from the corresponding said folded package.

2. The folding unit claim 1, wherein said conveying means comprise:

at least one supporting member;

a top branch along which said supporting member is arranged at a position below said sealed pack; and a bottom branch defining said output station and along which said folded package is arranged at a position below said supporting member;

said shells being arranged in said open position at least at said output station, so as to release said corresponding folded package under a gravity action.

3. The folding unit of claim 2, wherein said conveying means comprise at least one paddle operatively connected to said supporting member and adapted to thrust said corresponding package along said forming path.

4. The folding unit of claim 1, wherein said shells are also settable in a closed position which is intermediate along said transverse direction between said open and fully closed positions, and in which the shells grip said folded package and apply less pressure to said folded package than when said shells are in said fully closed position.

5. The folding unit of claim 4, wherein said forming path comprises:

a first portion along which each of said sealed packs is folded into a folded package;

a second portion arranged downstream from said first portion and along which each of the folded packages is overturned; and a third portion arranged downstream from said second portion and along which each of said folded packages is conveyed to said output station;

said shells being movable relative to each other between said open position and said fully closed position, parallel to said transverse direction and along said first portion of said path;

said shells being movable relative to each other between said fully closed position and said closed position, parallel to said transverse direction, and along said second portion of said path;

said shells being movable relative to each other between said closed and said open position, parallel to said transverse direction and along said third portion of said path.

6. The folding unit of claim 1, wherein said conveying means comprise a plurality of consecutive links articulated with respect to one another;

each said link comprising:

a paddle;

a pair of shells;

a pair of guides which extend along said transverse direction; and a pair of slides connected to said shells and slidable within said relative guides.

7. The folding unit of claim 6, wherein said pack includes a main portion, and a first and second end portions arranged on respective opposite sides of said main portion, said first end portion being said unfolded end portion;

said unfolded portion comprises a first fin, said unfolded end flap and a second flap projecting laterally from said main portion;

said folding means including at least one first folding member adapted to fold said first fin onto said first end portion and to bend said unfolded end flap and said second flap towards said second end portion;

said folding unit including heating means for partially melting said previously bent unfolded end flap and said previously bent second flap;

said shells being arranged in said fully closed position downstream from said heating means, proceeding along an advancing direction of said conveying means.

8. The folding unit of claim 7, wherein said folding means comprise at least one second folding member adapted to fold a second end fin, opposite to said first end fin, onto said second end portion and a pair of second flaps on the opposite side of said first end portion;

said second folding member being arranged upstream from said heating means, proceeding along the advancing direction of said conveying means;

said folding unit including a pressing device arranged downstream from said heating means, proceeding along the advancing direction of said conveying means;

said pressing device being adapted to hold said second flap in contact with said main portion while said second flap cools; and a compartment defined by said paddles of two consecutive links, said shells of one of said two consecutive links arranged in said fully closed position, said first folding member and said pressing device, the compartment being configured to control the volume of a package in formation.

9. The folding unit of claim 1, comprising:

a pair of cams defining grooves which are elongated along said forming path and arranged at varying distances measured along said transverse direction from each other;

each said shell comprising a relative follower which engages a relative groove of a relative cam.

10. The folding unit according to claim 1, wherein the at least one pair of shells comprises a plurality of pairs of shells;

the conveyor comprises a plurality of links; and each of the plurality of links includes one of the pairs of shells.

11. A method for producing folded packages of pourable food product from sealed packs comprising:

conveying at least one said sealed pack along a forming path in which a corresponding folded package is formed, said forming path including an input station and an output station, said pack comprising an unfolded portion;

folding said unfolded portion of said sealed pack while said pack is being conveyed along said forming path, an end flap of said unfolded portion remaining at least partially unfolded after said folding of said unfolded portion of said sealed pack;

moving at least one pair of shells integrally in conjunction with each other along said forming path and relative to each other along a transverse direction transverse to said forming path between a fully closed position in which the shells exert a pressure onto said sealed pack to contact and fold said end flap of said unfolded portion of said sealed pack;

said moving of said shells into said fully closed position completing said folding operation of said sealed pack;

integrally moving said shells in the same direction in conjunction with one another parallel to said transverse direction, upstream from said output station; and outputting said corresponding folded package at said output station of said forming path by moving said shells into an open position in which said shells are detached from said corresponding folded package.

12. The method of claim 11, wherein said conveying of the at least one sealed pack comprises:

arranging said sealed pack at a position above a supporting member;

arranging said corresponding folded package at a position below said supporting member, at a position upstream from said output station; and releasing said corresponding folded package under a gravity action at said output station.

13. The method of claim 12, comprising:

after moving said shells into said fully closed position, moving said pair of shells parallel to said transverse direction between said fully closed and a closed position, in which said shells grip said folded package to hold said folded package, said shells applying a greater pressure to said package when said shells are in said fully closed position than when said shells are in said closed position;

moving said pair of shells between said closed and said open position, parallel to said transverse direction; and said closed position being intermediate along said transverse direction between said fully closed and said open positions.

14. The method of claim 13, wherein said integrally moving of said shells in conjunction with one another parallel to said transverse direction is carried out when said shells are arranged in said closed position.

15. The method of claim 13, wherein said conveying of the at least one said sealed pack along a forming path includes:

folding said sealed pack along a first portion of said forming path, so as to form said folded package;

overturning said folded package along a second portion of said forming path arranged downstream from said first portion; and feeding said folded package to said output station along a third portion of said forming path;

said folding of said at least one sealed pack including moving said shells of each pair from said open to said fully closed position; and said overturning of said folded package including moving said shells of each pair from said fully closed to said closed position and integrally moving said shells relative to said corresponding paddle;

said feeding of said folded package including moving shells of each pair from said closed to said open position at said output station.

16. A folding unit for producing folded packages of pourable food products from respective sealed packs, comprising:

a conveyor that receives a plurality of the sealed packs at an input station, the conveyor being configured to convey the sealed packs along a forming path and output the folded packages at an output station;

the conveyor moving along a conveyor path, the conveyor path including a first curved portion, a top straight portion, a second curved portion, and a bottom straight portion, the top straight portion and bottom straight portion being spaced apart and each being between the first curved portion and the second curved portion;

folding means configured to cooperate with each of the plurality of sealed packs to perform at least one folding operation on the sealed pack;

two shells conveyed by the conveyor along the forming path, the two shells being movable in opposite directions relative to each other in a transverse direction to said forming path and also being movable together in the transverse direction such that both of said shells move together in the same direction away from the conveyor path in the transverse direction;

the two shells being movable relative to one another in the transverse direction to:

a fully closed position in which the two shells exert a pressure onto a respective pack of the plurality of sealed packs to fold flaps of the respective pack to complete a folding operation of the respective pack, the two shells being at the top straight portion of the conveyor path upstream of the second curved portion when the two shells move into the fully closed position; and an open position in which the two shells are detached from the respective pack after the respective pack has been folded to form a respective folded package.

17. The folding unit according to claim 16, wherein the two shells are configured to integrally move in the same direction away from the conveyor path when the two shells are at the bottom straight portion of the conveyor path.

18. The folding unit according to claim 16, further comprising:

a first arm extending in the transverse direction between a first shell of the two shells and a first roller;

a second arm extending in the transverse direction between a second shell of the two shells and a second roller;

a first cam comprising a first groove which the first roller moves within;

a second cam comprising a second groove which the second roller moves within; and the first roller moving within the first groove of the first cam and the second roller moving within the second groove of the second cam collectively causing the two shells to integrally move in conjunction with one another in the transverse direction.

* * * * *